US008535000B2

(12) United States Patent
Chiovelli

(10) Patent No.: US 8,535,000 B2
(45) Date of Patent: Sep. 17, 2013

(54) CENTRIFUGAL PUMP FOR SLURRIES

(75) Inventor: Stefano Chiovelli, Edmonton (CA)

(73) Assignee: Syncrude Canada Ltd., Fort McMurray (CA), in trust for the owners of the Syncrude Project as such owners exist now and in the future ( * ) Notice: Subject to any disclaimer, the term of this patent is extended or adjusted under 35 U.S.C. 154(b) by 600 days.

(21) Appl. No.: 12/766,652

(22) Filed: Apr. 23, 2010

(65) Prior Publication Data

US 2010/0272563 A1 Oct. 28, 2010

Related U.S. Application Data

(60) Provisional application No. 61/172,490, filed on Apr. 24, 2009.

(51) Int. Cl.
*F04D 1/00* (2006.01)

(52) U.S. Cl.
USPC ..... 415/196; 415/200; 415/206; 415/217.1; 416/241 R

(58) Field of Classification Search
USPC ..... 415/170.1, 196, 200, 206, 217.1; 416/185, 219 R, 224, 241 R
See application file for complete search history.

(56) References Cited

U.S. PATENT DOCUMENTS

| | | | | | |
|---|---|---|---|---|---|
| 2,262,039 | A | * | 11/1941 | Pekor | 416/186 R |
| 2,625,884 | A | * | 1/1953 | Welsh | 416/186 R |
| 4,563,801 | A | * | 1/1986 | Schill et al. | 29/889.4 |
| 4,671,740 | A | * | 6/1987 | Ormiston et al. | 416/241 B |
| 4,974,998 | A | * | 12/1990 | Heineman | 406/97 |
| 5,328,763 | A | * | 7/1994 | Terry | 428/559 |
| 5,513,954 | A | * | 5/1996 | Bourgeois | 415/197 |

FOREIGN PATENT DOCUMENTS

| | | | |
|---|---|---|---|
| JP | 10-259790 | * | 9/1998 |
| JP | 2001-107833 | * | 4/2001 |

OTHER PUBLICATIONS

Okada et al., Pump and its manufacture, Sep. 29, 2998, Abstract of JP 10-259790.*

Ikeda, Hydraulic machine and its manufacture, Apr. 17, 2001, Abstract of JP 2001-107833.*

* cited by examiner

*Primary Examiner* — Edward Look
*Assistant Examiner* — Liam McDowell
(74) *Attorney, Agent, or Firm* — Bennett Jones LLP

(57) ABSTRACT

A centrifugal pump is provided having a volute casing having a discharge conduit, an impeller provided in the volute casing, and a suction sideliner enclosing the impeller in the volute casing, the suction sideliner being at least partially covered with sintered tungsten carbide tiles. In one embodiment, the impellor has a central hub, a plurality of vanes spacedly attached to the hub, and at least one side plate attached to the vanes, whereby each vane is individually wear protected prior to attaching each vane to the hub.

15 Claims, 5 Drawing Sheets

CENTRIFUGAL PUMP FOR SLURRIES

CROSS REFERENCE TO RELATED APPLICATIONS

The present application claims priority under 35 U.S.C. §119(e) to U.S. provisional patent application No. 61/172,490 filed Apr. 24, 2009.

FIELD OF THE INVENTION

The present invention relates to pumps and more specifically to centrifugal pumps for slurries containing solid particles.

BACKGROUND OF THE INVENTION

Centrifugal pumps are commonly used for pumping liquids. For some liquids, such as those that contain hydrocarbons and/or water, corrosion problems arise. If the liquid is a slurry that contains solid particles suspended in it, such as an oil sand/water slurry, a tailings/water slurry, a coke/water slurry, etc. the solid particles can cause erosion/corrosion or other forms of wear to the components of the pump. Additionally, because of how centrifugal pumps operate, different components may be subjected to different forms and severity of wear and/or corrosion. Even different surfaces of the same component may be subjected to different conditions causing different forms and severity of wear and/or corrosion.

Often these centrifugal pumps are critical components of a larger system and in some cases these pumps may be the run-limiting component in these systems with respect to system reliability. Once the centrifugal pump fails, needs maintenance or components of the pump need replacing, the entire system may have to be shut down while the pump is being repaired or components replaced. Any extension of pump life that can be achieved can greatly increase the efficiency of the systems these pumps are used in.

Currently, the wet end components of these centrifugal pumps are cast as single components, requiring a single material, typically chromium white iron (CWI), to be used for these components. This can greatly limit the ability to surface engineer the various components and surfaces to tailor the performance of these parts for the operating conditions in the pump.

SUMMARY OF THE INVENTION

In a first aspect, an impellor for use in a centrifugal pump is provided. The impellor has a central hub, a plurality of vanes spacedly attached to the hub, and at least one side plate attached to the vanes, whereby each vane is individually wear protected prior to attaching each vane to the hub. In one embodiment, the wear protection comprises tungsten carbide. In another embodiment the wear protection could be any suitable corrosion resistant/wear resistant material as appropriate. The wear material may be integral or may be attached by welding, brazing, adhesion, some form of mechanical attachment or other suitable method, or any combination thereof.

In a second aspect, a centrifugal pump is provided having a volute casing having a discharge conduit, an impeller provided in the volute casing, and a suction sideliner enclosing the impeller in the volute casing, the suction sideliner being at least partially covered with sintered tungsten carbide tiles.

In a third aspect, a centrifugal pump is provided having a volute casing having a discharge conduit, an impeller provided in the volute casing, the impeller assembled from a plurality of vanes joined to a central hub and connected between a first side plate and a second side plate, a suction sideliner enclosing the impeller in the volute casing, the suction sideliner having a coating on the interior surface and an intake conduit directed towards the impeller.

BRIEF DESCRIPTION OF THE DRAWINGS

Referring to the drawings wherein like reference numerals indicate similar parts throughout the several views, several aspects of the present invention are illustrated by way of example, and not by way of limitation, in detail in the figures, wherein.

DESCRIPTION OF VARIOUS EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

Figure 1:
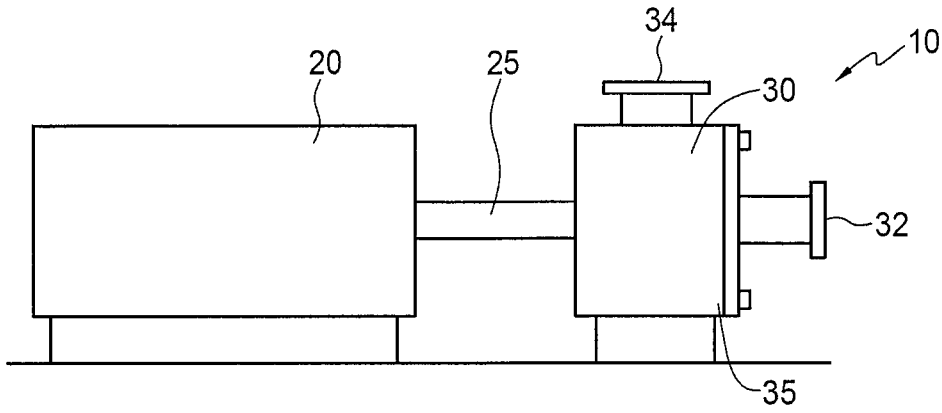
FIG. 1 is a side view of a pump in accordance with the present invention.
Figure 2:
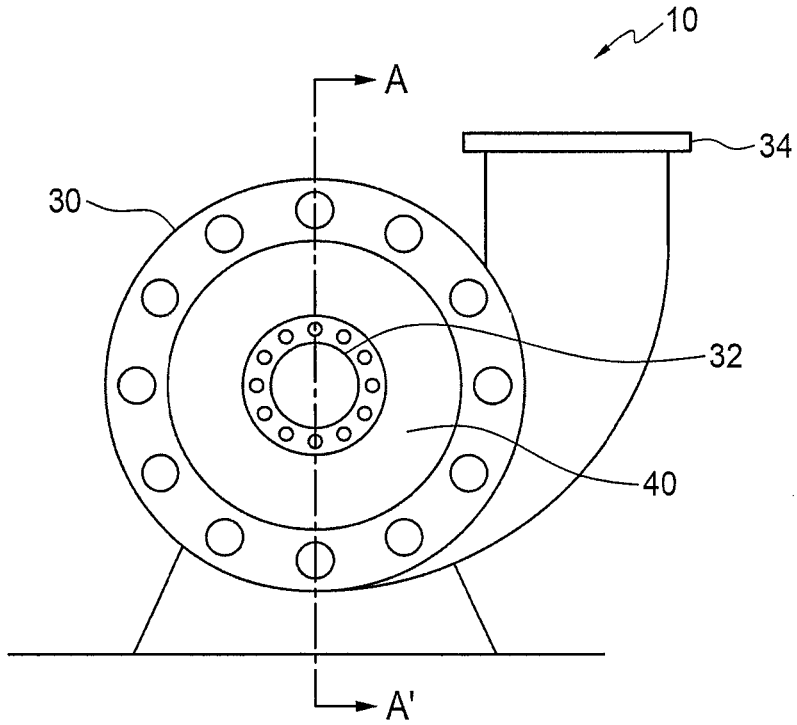
FIG. 2 is a front view of the pump in FIG. 1.

FIGS. 1 and 2 illustrate a centrifugal pump 10. The centrifugal pump 10 has a motor 20, such as electric motor, turbine, etc., that drives the pump 10 and is connected to an impeller (not shown) by a shaft 25. The impeller is provided in a volute casing 30. An intake conduit 32 is provided in the volute casing 30 to route liquid into the pump 10, where the liquid will be subsequently discharged from the pump 10 through a discharge conduit 34 provided in the volute casing 30. A suction sideliner 40 is provided to allow access to the inside of the volute casing 30.

Figure 3:
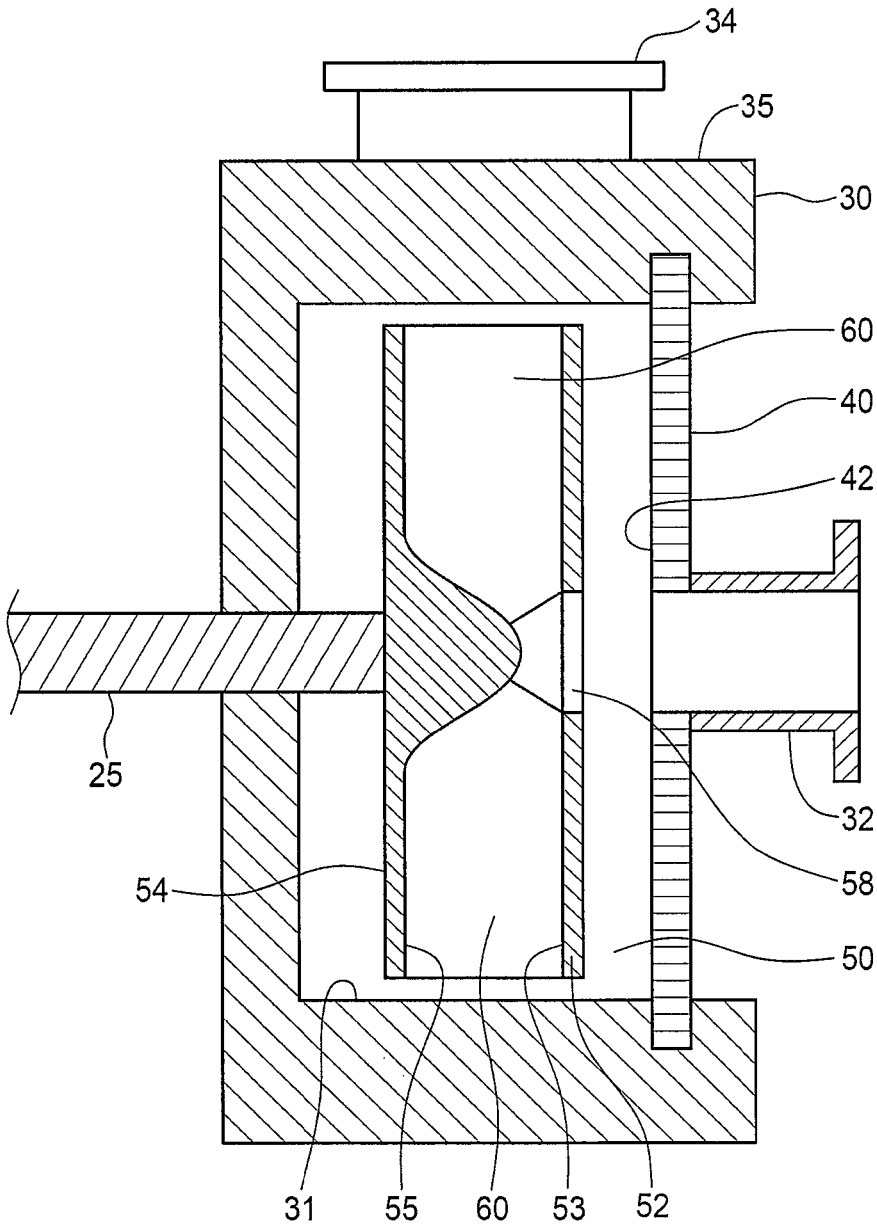
FIG. 3 is a side sectional view of a volute casing of the pump shown in FIG. 2 along sectional line AA'.

FIG. 3 illustrates an impeller 50 provided in the volute casing 30. The impeller 50 is connected to the shaft 25 and is rotated during operation of the pump 10.

Referring to FIGS. 1-3, in operation, liquid enters the centrifugal pump 10 through the intake conduit 32 where it is routed to the impeller 50. The impeller 50 is rotated by the motor 20 causing the incoming liquid to be drawn into the impeller 50 through an eye 58 of the impeller 50. From the eye 58 of the impeller 50, the rotation of the impeller 50 causes vanes 60 in the impeller 50 to force the liquid that has entered the impeller 50 through the eye 58 outwards to a periphery of the impeller 50 and out into the volute casing 30. The vanes 60 of the impeller 50 impose radial forces on the liquid that has entered the impeller 50, forcing the liquid to the periphery of the impeller 50 and out into the volute casing 30. The volute casing 30 collects the liquid that exits the impeller 50 and directs it out the discharge conduit 34. Typically, the liquid exiting the impeller 50 has a relatively high velocity and the volute casing 30 is shaped to convert this relatively high velocity into pressure.

Because of the operation of the pump 10, the components of the pump 10 are subjected to various loads and forces depending on their use in the pump 10. Some components, such as wetted surface 31 of the volute casing 30, wetted surface 42 of the sideliner 40 and the impeller 50 come into direct contact with the liquid being pumped by the pump 10. In some applications the liquid may be corrosives, such as when the liquid pumped includes hydrocarbons or water. Additionally, when the liquid being pumped is a slurry, such as an oil sand/water slurry, tailing/water slurry, coke/water slurry, etc., the presence of solids in the liquid can have a abrasive effect on the components of the pump 10 that come into direct contact with the liquid, causing wear problems with these components. However, because of the operation of the different components in the pump 10, the different components are subjected to different forces, loads, etc. which can result in the components being subjected to different corrosion/erosion and/or wear conditions. Even those components that come into direct contact with the liquid may be subjected to different conditions. The components of the pump 10 can therefore be chosen and manufactured to address each component's operating conditions.

The liquid passing through the pump 10 comes into direct contact with the wetted surface 31 of the volute casing 30. Because of the action of the impeller 50 which forces the liquid outwards out of the impeller 50 and against the interior surface 32 of the volute casing 30, the volute casing 30 can be exposed to significant wear and/or corrosion by the liquid constantly being forced against its wetted surface 31. This can be especially true when the liquid contains solid particles such as when the liquid is a slurry. In one aspect, the volute casing 30 of the pump 10 can be made of chromium white iron, such as being cast in chromium white iron.

The sideliner 40 connects to an end 35 of the volute casing 30 and has a wetted surface 42 that can come into contact with liquid passing through the pump 10. Liquid entering the inlet conduit 32 is routed through the sideliner 40 to the eye 58 of the impeller 50. The wetted surface 42 of the sideliner 40 faces the impeller 50. When the pump 10 is in operation, liquid entering the pump 10 through the inlet conduit 32 can pass between the impeller 50 and the wetted surface 42 of the sideliner 40. If the liquid is corrosive and/or contains solid particles making it abrasive, the interior surface 42 of the sideliner 40 can be subjected to significant wear. This wear may be significant because the impeller 50 is rotating during the operation of the pump 10, while the sideliner 40 is stationary resulting in a relative rotational motion between the impeller 50 and the interior surface 42 of the sideliner 40. In addition, local re-circulation may occur, dramatically increasing local wear rates.

Figure 8:
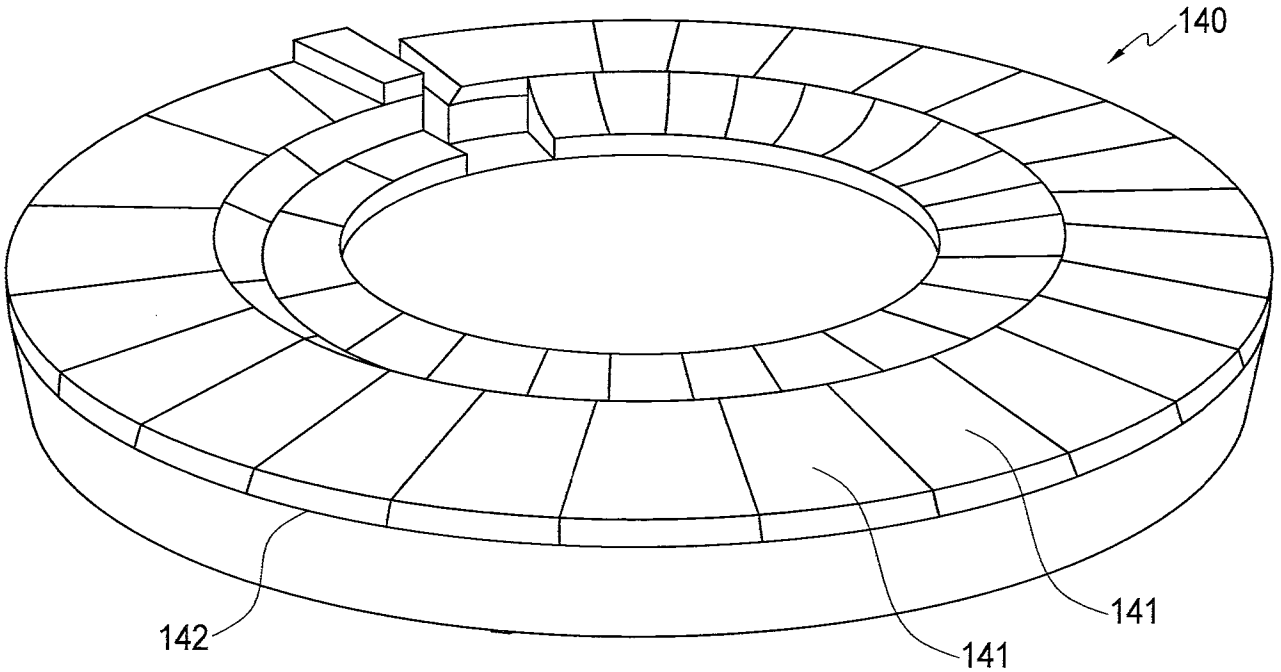
FIG. 8 is a perspective view of a sideliner having tungsten carbide tiles attached to its inner surface.

To address the fact that the interior surface 42 of the sideliner 40 can be subjected to significant wear from the liquid passing through the pump 10, the sideliner 40 can be made of a material such as carbon steel and in one aspect the sideliner 40 may be cast of ASTM A487 CA6NM, carbon steel, or other suitable material. Additionally or in the alternative, the wetted surface 42 of the sideliner 40 can have a wear and/or corrosion resistant material applied to it, such as by a coating. In one aspect, the wetted surface 42 of the sideliner 40 can have a layer of tungsten carbide applied to it, such as by having tungsten carbide tiles attached to the wetted surface 42 such as by adhesion, brazing, mechanical fastening, etc. The tungsten carbide tiles can provide a protective layer for the interior surface 42 of the sideliner 40. FIG. 8 shows a perspective view of a sideline 140, for example, from a GIW TBC 57.5 pump, which has been tiled with tungsten carbide tiles 141. The carbon tungsten tiles 141 were vacuum bonded to the interior surface 142 of the sideliner 140, which is made of a chromium white iron base material.

The impeller 50 comes into direct contact with the liquid passing through the pump 10 during the operation of the pump 10. It is the impeller 50 and specifically the vanes 60 that impart energy to the liquid, causing the liquid to accelerate towards the periphery of the impeller 50 and out into the volute casing 30. The components of the impeller 50 can therefore be affected by this contact with the liquid/slurry. Additionally, the different components of the impeller 50 come into contact with the liquid/slurry under different conditions. For example, during the operation of the pump, the vanes 60 are forced directly against the liquid/slurry, while other components of the impeller 50 have the liquid flowing along them and traveling laterally relative to them. This can result in different components of the impeller 50, itself, being subjected to different conditions as a result of contact with liquid passing through the pump 10. Rather than casting the impeller as a single component, as is commonly done, the impeller 50 can be made of a number of components that are formed separately and then assembled together to form the completed impeller 50. This allows each component of the impeller 50 to be individually tailored to that component's specific function in the impeller 50.

Figure 4:
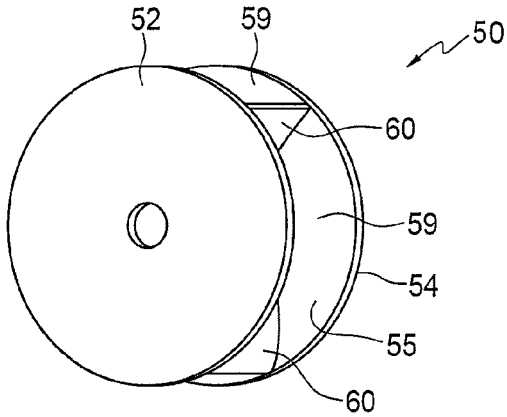
FIG. 4 is a perspective view of an impeller.
Figure 5:
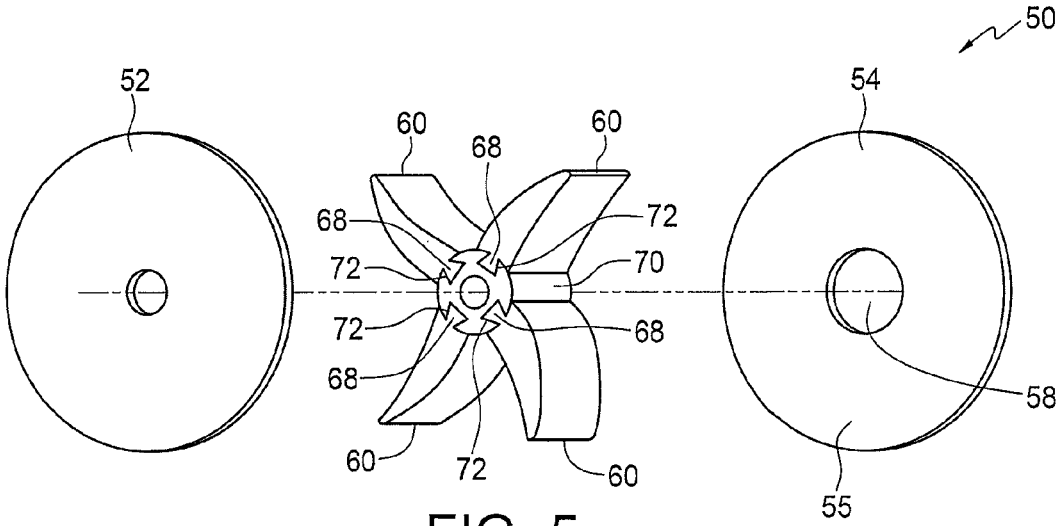
FIG. 5 is an exploded view of the impeller shown in FIG. 4.

FIG. 4 illustrates the impeller 50 in a perspective view and FIG. 5 illustrates the impeller 50 in an exploded view. The impeller 50 has a first side plate 52 and a second side plate 54. Positioned between the first side plate 52 and the second side plate 54 are a plurality of vanes 60. Each of the vanes 60 are connected to a central hub 70. The central hub 70 can have a number of tails 72, with each tail 72 mateable with a pin 68 on one of the vanes 60. In an aspect, the pin 68 can extend outwards as it extends from the vane 60 with the tails 72 shaped to mate with the pins 68. In this manner, when a pin 68 on one of the vanes 60 is slid sideways into one of the tails 72 in the central hub 70, the vane 60 cannot be pulled radially out of the central hub 72. The vanes 60 and the central hub 70 are positioned between the first side plate 52 and the second side plate 54 and the first side plate 52 and the second side plate 54 are mechanically connected, compressing and holding the vanes 60 in place in the completed impeller 50.

The first side plate 52 and the second side plate 54 can be formed of wear and/or corrosion resistant material. In one aspect, the first side plate 52 and the second side plate 54 could be formed of a material such as carbon steel, for example, ASTM A487 CA6NM, stainless steel, or any other similar material, preferably a material that is compatible with the application of additional wear protection. Because the first side plate 52 and the second side plate 54 are formed separately from the other components of the impeller 50, the inner surfaces 53, 55 can be coated, such as having an wear protection of material provided over them, before the impeller 50 is assembled.

The central hub 70 can be formed, cast, machined, forged, etc. of a corrosion/wear resistant material, such as chromium white iron, CANGM stainless steel, carbon steel, stainless steel, etc., preferably a material that is compatible with additional wear protection.

Impeller 50 is shown as a closed vane impeller. Closed vane impellers, also called enclosed or shrouded impellers, provide benefits in certain applications over open or semi-open vane impellers. However, the vanes of a closed vane impeller are enclosed in passages running between the sides of the impeller, making it hard to apply wear protection or other surface treatments to the surfaces of the vanes. In a closed vane impeller that has been formed as a single piece, it is often hard, if not impossible, to apply a coating to the entire surface of the vanes because the surfaces of the vane located proximate the center of the impeller are not easily accessible or even accessible at all to the person or device applying the coating. Because impeller 50 is formed of a number of components that are then assembled into the completed impeller 50, the vanes 60 can be separately formed before they are assembled with other components into the completed impeller 50.

Figure 6:
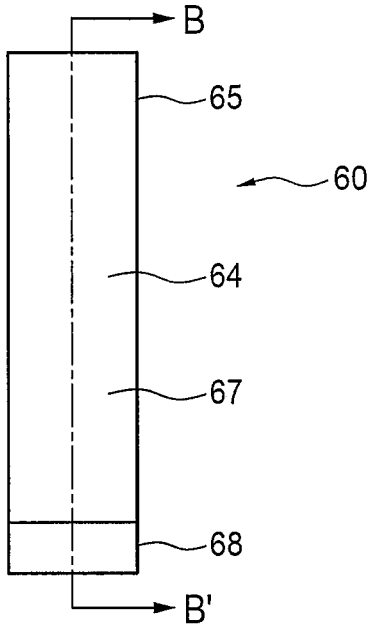
FIG. 6 is a front view of an impeller vane.
Figure 7:
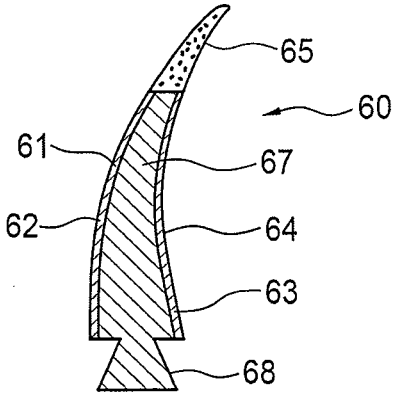
FIG. 7 is a side sectional view of the impeller vane shown in FIG. 6, along line BB.

FIGS. 6 and 7 illustrate one of the vanes 60 before the vane 60 is assembled into a completed impeller 50 as shown in FIG. 4. The vane 60 has a profile that is selected for the operating characteristics desired for the pump 10. The vane 60 imparts energy to the liquid passing through the impeller 50 to accelerate the liquid towards the periphery of the impeller 50. This energy is imparted by the rotation of the impeller 50 during operation of the pump 10 which forces the vanes 60 against the liquid. Because of this, the vanes 60 can be subjected, to significant wear including erosion/abrasion by the liquid passing through the pump 10, especially if there are solid particles present in the liquid. The vanes 60 move substantially perpendicularly to the flow of liquid passing through the pump 10. This can impose a force from the liquid directly on a leading surface 62 of each vane 60. If the liquid contains solid particles suspended in it, these solid particles can subject the vanes 60 to increased wear by the vanes 60 being impacted and abraded by the solid particles. The vanes 60 may therefore be subjected to different conditions than other components in the pump 10.

By forming the vanes 60 separately from the other components in the impeller 50, the material(s) of the vane 60 can be chosen separately from the materials used for the other components of the impeller 50 and constructed with suitable manufacturing techniques. The vane 60 can be cast, forged, machine, etc. In one aspect, a body 67 of the vane 60 can be formed from a first material and then a tip 65 can be attached to the body 67. In one aspect, the tip 65 can be formed of solid sintered tungsten carbide.

The body 67 of the vane 60 can, in a further aspect, be provided with a surface treatment to increase its wear resistance. In one aspect, this surface treatment could be a wear resistant coating, such as a tungsten carbide coating, with the leading surface 62 having a first coating 61 and the trailing surface 64 having a second coating 63 applied over them. The wear resistant coating may be applied using any compatible technology such as by thermal spraying of coating, weld wear protectioning, etc. If desired, the first coating 61 on the leading surface 62, which is forced against the liquid by the rotation of the impeller 50, can be applied thicker than the second coating 63 applied to the trailing surface 64 and/or can consist of a different material. In another aspect, this coating could be ceramic tiles, carbide tiles, etc, that are applied to the surface vane 60, such as by use of adhesives, mechanical attachment, brazing, etc.

Because the vane 60 is formed separately from the other components in the impeller 50, the leading surface 62 and the trailing surface 64 are easily accessible to a person or device applying the surface treatment. This allows the person or device to easily apply a surface treatment, such as a wear resistant coating to the desired thickness and coverage. Alternatively, the part may be manufactured as a monolithic component, such as a solid sintered carbide, etc.

Referring again to FIGS. 4 and 5, once the vanes 60 have been formed and any surface treatment, such as surface coatings, etc. have been applied to the vanes 60, the vanes 60 can be attached to the central hub 70, by sliding the pins 68 on the vanes 60 into one of the tails 72 on the central hub 70, to join the vanes 60 to the central hub 70. The central hub 70 and the connected vanes 60 can then be positioned between the first side plate 52 and the second side plate 54 and the first side plate 52 and the second side plate 54 can be connected together, forming the completed impeller 50. With the vanes 60, central hub 70, first side plate 52 and second side plate 54 in place, a number of passages 59 are formed. The liquid that has entered the impeller 50 through the eye 58 flows through these passages 59. Each passage 59 is defined by the trailing surface 64 of a vane 60, the leading surface 62 of an adjacent vane 60 and the inner surfaces 53, 55 of the first side plate 52 and the second side plate 54, respectively. In this manner, each surface defining one of the passages 59 can be formed of a different material. This completed impeller 50 can then be installed in the pump 10.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

The invention claimed is:

1. An impeller for use in a centrifugal pump, comprising, as individual components:

a central hub;

a plurality of vanes each comprising a body having a first end and a second end, the second end operable for spacedly attaching each vane to the hub;

a plurality of solid tips, each respective solid tip attachable to a corresponding first end of each of the vanes; and at least one side plate attached to the vanes;

wherein each of the central hub, the plurality of vanes and the plurality of solid tips is individually wear protected prior to assembly and wherein each of the central hub, the plurality of vanes and the plurality of solid tips is formed from a different material.

2. The impeller of claim 1, wherein the wear protection is applied to the vane by thermal spraying or weld wear protection.

3. The impeller of claim 1 wherein the wear protection comprises tungsten carbide.

4. The impeller of claim 1, wherein the solid tip is made of sintered tungsten carbide.

5. The impeller of claim 1, wherein the hub to which the plurality of individual vanes can be spacedly attached is made from at least one of: chromium white iron; stainless steel; and carbon steel.

6. The impeller of claim 1, further comprising two side plates for attaching to the vanes.

7. The impeller of claim 6, wherein each side plate is made from the same material.

8. The impeller of claim 6, wherein each side plate is made from a different material.

9. The impeller of claim 1, wherein the plurality of individual vanes are made from a different material than the at least one side plate.

10. A centrifugal pump is provided having a volute casing having a discharge conduit, an impeller provided in the volute casing, and a suction sideliner, made from at least one of chromium white iron, stainless steel, and carbon steel, enclosing the impeller in the volute casing, the suction sideliner having an interior wetted surface being at least partially covered with sintered tungsten carbide tiles.

11. A centrifugal pump comprising:

a volute casing having a discharge conduit;

an impeller provided in the volute casing, the impeller assembled from a plurality of vanes joined to a central hub and connected between a first side plate and a second side plate;

a suctionliner enclosing the impeller in the volute casing, the suction sideliner made from at least one of chromium white iron, stainless steel, and carbon steel and having a wear resistant material applied to an interior wetted surface of the suction sideliner; and an intake conduit directed towards the impeller.

12. The centrifugal pump of claim 11 wherein the volute casing is cast with chromium white iron.

13. The centrifugal pump of claim 12 wherein the wear resistant material applied to the interior surface of the sideliner is tungsten carbide.

14. The centrifugal pump of claim 13 wherein the tungsten carbide coating on the interior surface of the sideliner comprises plurality of tungsten carbide tiles attached to the wetted surface of the sideliner.

15. The centrifugal pump of claim 14, wherein the tungsten carbide tiles are attached by adhesion, brazing, mechanical fastening or vacuum bonding.

* * * * *